US010001126B2

(12) United States Patent
Miwata et al.

(10) Patent No.: US 10,001,126 B2
(45) Date of Patent: Jun. 19, 2018

(54) VACUUM PUMP

(75) Inventors: Tooru Miwata, Chiba (JP); Keiichi Ishii, Chiba (JP); Katsuhide Machida, Chiba (JP); Yoshinobu Ohtachi, Chiba (JP); Yasushi Maejima, Chiba (JP); Tsutomu Takaada, Chiba (JP)

(73) Assignee: Edwards Japan Limited, Chiba (JP)

( * ) Notice: Subject to any disclaimer, the term of this patent is extended or adjusted under 35 U.S.C. 154(b) by 1091 days.

(21) Appl. No.: 13/381,254

(22) PCT Filed: Jun. 14, 2010

(86) PCT No.: PCT/JP2010/060041
§ 371 (c)(1),
(2), (4) Date: Dec. 28, 2011

(87) PCT Pub. No.: WO2011/021428
PCT Pub. Date: Feb. 24, 2011

(65) Prior Publication Data

US 2012/0143390 A1 Jun. 7, 2012

(30) Foreign Application Priority Data

Aug. 21, 2009 (JP) ..... 2009-192565

(51) Int. Cl.
*F04D 19/04* (2006.01)
*F04D 29/58* (2006.01)
*F04D 27/00* (2006.01)

(52) U.S. Cl.
CPC ..... *F04D 19/042* (2013.01); *F04D 27/001* (2013.01); *F04D 29/584* (2013.01); *F05D 2270/303* (2013.01)

(58) Field of Classification Search
CPC ..... F04D 29/584; F04D 19/042; F04D 27/001
See application file for complete search history.

(56) References Cited

U.S. PATENT DOCUMENTS 5,190,438 A * 3/1993 Taniyama et al. ..... 415/90
5,303,767 A * 4/1994 Riley ..... F24F 3/044 165/208

(Continued)

FOREIGN PATENT DOCUMENTS

EP 1508700 A2 2/2005
JP 2252996 A 11/1990

(Continued)

OTHER PUBLICATIONS

Translation of Chinese Office Action from counterpart Chinese Application No. 2010800365424, dated Jan. 10, 2014, 6 pp.

(Continued)

*Primary Examiner* — Nathan L Laughlin
(74) *Attorney, Agent, or Firm* — Shumaker & Sieffert, P.A.

(57) ABSTRACT

To provide a vacuum pump capable of performing temperature control using one or more heating devices or cooling devices fewer than the number of temperature sensors arranged in the pump. One temperature sensor is arranged for each target in the pump, while only one set consisting of a heater and a magnetic valve is arranged. One set consisting of a heater and a magnetic valve is controlled based on output signals from a plurality of temperature sensors, based on the priorities set for the temperature sensors. As stated above, by setting priorities for the temperature sensors, the temperature of a target provided with a temperature sensor given a higher priority is settled within a control range by performing quick ON/OFF control, and then the temperature of a target provided with a temperature sensor given a lower priority is settled within the control range.

5 Claims, 6 Drawing Sheets

(56) References Cited

U.S. PATENT DOCUMENTS

| | | | | |
|---|---|---|---|---|
| 5,577,883 | A * | 11/1996 | Schutz | F04D 19/04 415/177 |
| 5,879,139 | A * | 3/1999 | Hayashi et al. | 417/292 |
| 6,022,195 | A * | 2/2000 | Gaudet | F04B 37/08 417/27 |
| 6,926,493 | B1 * | 8/2005 | Miyamoto et al. | 415/90 |
| 7,232,295 | B2 * | 6/2007 | Kriehn | F04C 18/086 417/368 |
| 7,717,684 | B2 * | 5/2010 | Sekiguchi et al. | 417/423.4 |
| 8,061,417 | B2 * | 11/2011 | Gray | F24F 11/006 165/208 |
| 8,793,007 | B2 * | 7/2014 | Philippe et al. | 700/108 |
| 2002/0018727 | A1 * | 2/2002 | Yamauchi | 417/313 |
| 2003/0161733 | A1 * | 8/2003 | Kabasawa et al. | 417/32 |
| 2003/0175131 | A1 * | 9/2003 | Ishikawa | 417/353 |
| 2003/0175132 | A1 * | 9/2003 | Ishikawa | 417/353 |
| 2004/0081560 | A1 | 4/2004 | Blumenthal et al. | |
| 2005/0042118 | A1 * | 2/2005 | Sekiguchi | F04D 19/04 417/423.4 |
| 2007/0031270 | A1 * | 2/2007 | Maejima | F04D 19/04 417/423.4 |
| 2009/0317261 | A1 * | 12/2009 | Bruce | 417/32 |

FOREIGN PATENT DOCUMENTS

| | | | |
|---|---|---|---|
| JP | 2001329991 | A | 11/2001 |
| JP | 2002257079 | A | 9/2002 |
| JP | 2002285992 | A | 10/2002 |
| JP | 2003278692 | A | 10/2003 |
| JP | 2004522040 | A | 7/2004 |
| JP | 2005069066 | A | 3/2005 |
| JP | 2006017089 | A | 1/2006 |
| JP | 2009174333 | A | 8/2009 |

OTHER PUBLICATIONS

Translation of the Official Rejection dated Mar. 18, 2014 in counterpart JP Application No. 2011-527605, 3 pgs.

English Translation of the Notification of Reasons for Refusal from counterpart Japanese Patent Application No. 2011-527605, dated Dec. 16, 2014, 5 pp.

Search Report from counterpart European Application No. 10809774.2, dated Nov. 10, 2015, 10 pp.

Communication pursuant to Article 94(3) EPC dated Sep. 19, 2017 in counterpart EP Application No. 10809774.2, 5 pps.

* cited by examiner

VACUUM PUMP

This application is a national stage entry under 35 U.S.C. § 371 of International Application No. PCT/JP2010/060041, filed Jun. 14, 2010, which claims priority to JP Application 2009-192565, filed Aug. 21, 2009.

TECHNICAL FIELD

The present invention relates to a vacuum pump having a heating device or a cooling device, and particularly relates to a vacuum pump capable of performing temperature control using one or more heating devices or cooling devices fewer than the number of temperature sensors arranged in the pump.

BACKGROUND

As a result of the recent development of electronics, there is a rapid increase in the demand for semiconductor devices such as memories and integrated circuits.

Such a semiconductor device is manufactured by doping impurities into a highly pure semiconductor substrate to impart electrical properties thereto, and forming a minute circuit on the semiconductor substrate by etching, for example.

Such operations must be performed in a chamber in a high-vacuum state to avoid the influence of dust or the like in the air. A vacuum pump is generally used to evacuate the chamber. In particular, a turbo-molecular pump, which is a kind of vacuum pump, is widely used since it involves little residual gas and is easy to maintain.

When manufacturing a semiconductor, these are many steps for making various process gases act on a semiconductor substrate, and the turbo-molecular pump is used not only to create a vacuum in a chamber, but also to discharge these process gases from the chamber. FIG. 6 is a longitudinal sectional view of such a turbo-molecular pump.

In FIG. 6, a turbo-molecular pump 100 has an inlet port 101 formed at the upper end of an outer cylinder 127. Inside the outer cylinder 127, there is provided a rotor 103 having in its periphery a plurality of rotary blades 102*a*, 102*b*, 102*c*, . . . formed radially in a number of stages and constituting turbine blades for sucking and discharging gas.

A rotor shaft 113 is mounted at the center of the rotor 103, and is levitated and supported in the air and controlled in position by a so-called 5-axis control magnetic bearing, for example.

Four upper radial electromagnets 104 are arranged in pairs in the X and Y axes which are perpendicular to each other and serve as the radial coordinate axes of the rotor shaft 113. An upper radial sensor 107 formed of four electromagnets is provided in close vicinity to and in correspondence with the upper radial electromagnets 104. The upper radial sensor 107 detects a radial displacement of the rotor 103 and transmits the detection result to a control device (not shown).

Based on the displacement signal from the upper radial sensor 107, the control device controls the excitation of the upper radial electromagnets 104 through a compensation circuit having a PID adjusting function, thereby adjusting the upper radial position of the rotor shaft 113.

The rotor shaft 113 is formed of a material having a high magnetic permeability (e.g., iron), and is attracted by the magnetic force of the upper radial electromagnets 104. Such adjustment is performed independently in the X- and Y-axis directions.

Further, lower radial electromagnets 105 and a lower radial sensor 108 are arranged similarly to the upper radial electromagnets 104 and the upper radial sensor 107 to adjust the lower radial position of the rotor shaft 113 similarly to the upper radial position thereof.

Further, axial electromagnets 106A and 106B are arranged with a metal disc 111 vertically sandwiched therebetween, the metal disc 111 having a circular plate-like shape and arranged at the bottom of the rotor shaft 113. The metal disc 111 is formed of a material having a high magnetic permeability, such as iron. An axial sensor 109 is arranged to detect an axial displacement of the rotor shaft 113, and its axial displacement signal is transmitted to the control device.

The axial electromagnets 106A and 106B are excitation-controlled based on this axial displacement signal through a compensation circuit having a PID adjusting function in the control device. The axial electromagnet 106A and the axial electromagnet 106B attract the metal disc 111 upward and downward respectively by their magnetic force.

In this way, the control device appropriately adjusts the magnetic force exerted on the metal disc 111 by the axial electromagnets 106A and 106E to magnetically levitate the rotor shaft 113 in the axial direction while supporting it in space in a non-contact state.

A motor 121 has a plurality of magnetic poles circumferentially arranged around the rotor shaft 113. Each magnetic pole is controlled by the control device to rotate and drive the rotor shaft 113 through the electromagnetic force acting between the rotor shaft 113 and the magnetic pole.

Further, a phase sensor (not shown) is provided near the lower radial sensor 108 for example, to detect the rotational phase of the rotor shaft 113.

A plurality of stationary blades 123*a*, 123*b*, 123*c*, . . . are arranged apart from the rotary blades 102*a*, 102*b*, 102*c*, . . . with small gaps therebetween. The rotary blades 102*a*, 102*b*, 102*c*, . . . are inclined by a predetermined angle from a plane perpendicular to the axis of the rotor shaft 113 in order to transfer the molecules of exhaust gas downward through collision, Similarly, the stationary blades 123 are inclined by a predetermined angle from a plane perpendicular to the axis of the rotor shaft 113, and arranged alternately with the rotary blades 102 so as to extend toward the inner side of tie outer cylinder 127.

One ends of the stationary blades 123 are supported while being fitted into the spaces between a plurality of stationary blade spacers 125*a*, 125*b*, 125*c*, . . . stacked together.

The stationary blade spacers 125 are ring-like members which are formed of, e.g., aluminum, iron, stainless steel, copper, or an alloy containing some of these metals.

The outer cylinder 127 is fixed on the outer periphery of the stationary blade spacers 125 with a small gap therebetween. A base portion 129 is arranged at the bottom of the outer cylinder 127, and a threaded spacer 131 is arranged between the lower end of the stationary blade spacers 125 and the base portion 129. An exhaust port 133 is formed under the threaded spacer 131 in the base portion 129, and communicates with the exterior.

The threaded spacer 131 is a cylindrical member formed of aluminum, copper, stainless steel, iron, or an alloy containing some of these metals, and has a plurality of spiral thread grooves 131*a* in its inner peripheral surface.

The direction of the spiral of the thread grooves 131*a* is determined so that the molecules of the exhaust gas moving in the rotational direction of the rotor 103 are transferred toward the exhaust port 133.

At the lowest end of the rotary blades 102*a*, 102*b*, 102*c*, . . . of the rotor 103, a rotary blade 102*d* extends vertically downward. The outer peripheral surface of this rotary blade 102*d* is cylindrical, and extends toward the inner peripheral surface of the threaded spacer 131 so as to be close to the inner peripheral surface of the threaded spacer 131 with a predetermined gap therebetween, The base portion 129 is a disc-like member constituting the base portion of the turbo-molecular pump 100, and is generally formed of a metal such as iron, aluminum, and stainless steel.

Further, the base portion 129 physically retains the turbo-molecular pump 100 while serving as a heat conduction path. Thus, it is desirable that the base portion 129 is formed of a metal having rigidity and high heat conductivity, such as iron, aluminum, and copper.

In this configuration, when the rotor shaft 113 is driven by the motor 121 and rotates with the rotary blades 102, exhaust gas from the chamber is sucked in through the inlet port 101 by the action of the rotary blades 102 and the stationary blades 123.

The exhaust gas sucked in through the inlet port 101 flows between the rotary blades 102 and the stationary blades 123 to be transferred to the base portion 129. At this time, the temperature of the rotary blades 102 increases due to frictional heat generated when the exhaust gas comes into contact with or collides with the rotary blades 102, conductive heat and radiation heat generated from the motor 121, for example. This heat is transmitted to the stationary blades 123 through radiation or conduction by gas molecules of the exhaust gas etc.

The stationary blade spacers 125 are connected together in the outer periphery and transmit, to the outer cylinder 127 and the threaded spacer 131, heat received by the stationary blades 123 from the rotary blades 102, frictional heat generated when the exhaust gas comes into contact with or collides with the stationary blades 123, etc.

The exhaust gas transferred to the threaded spacer 131 is transmitted to the exhaust port 133 while being guided by the thread grooves 131*a*.

In the example explained above, the threaded spacer 131 is arranged in the outer periphery of the rotary blade 102*d*, and the threaded grooves 131*a* are formed in the inner peripheral surface of the threaded spacer 131. However, in some cases, the threaded grooves may be formed in the outer peripheral surface of the rotary blade 102*d* so that a spacer having a cylindrical inner peripheral surface is arranged around the threaded grooves.

Further, in order to prevent the gas sucked in through the inlet port 101 from entering an electrical component section formed of the motor 121, the lower radial electromagnets 105, the lower radial sensor 108, the upper radial electromagnets 104, the upper radial sensor 107, etc., the electrical component section is covered with a stator column 122, and the inside of this electrical component section is kept at a predetermined pressure by a purge gas.

Accordingly, piping (not shown) is arranged in the base portion 129, and the purge gas is introduced through this piping. The introduced purge gas is transmitted to the exhaust port 133 through the gap between a protective bearing 120 and the rotor shaft 113, the gap between the rotor and stators of the motor 121, and the gap between the stator column 122 and the rotor 103.

Note that the turbo-molecular pump 100 must be controlled based on individually adjusted specific parameters (e.g., a specific model and characteristics corresponding to the model). The turbo-molecular pump 100 has an electronic circuit portion 141 in its main body to store these control parameters and maintenance information such as error history, for example. The electronic circuit portion 141 is formed of electronic parts such as a semiconductor memory like EEP-ROM and a semiconductor device for the access thereto, a board 143 for mounting the electronic parts, and so on.

This electronic circuit portion 141 is accommodated in the central portion of the base portion 129 constituting the lower portion of the turbo-molecular pump 100, and is closed by a hermetic bottom cover 145.

In same cases, the process gas is introduced into the chamber at high temperature to increase reactivity. Such a process gas cooled to a certain temperature at the time of discharge may be turned into solid to precipitate a product in the exhaust system.

Such a process gas attains low temperature inside the turbo-molecular pump 100 to be turned into solid, adhering to the inner surfaces of the turbo-molecular pump 100 to be deposited thereon.

When the precipitate of the process gas is deposited in the turbo-molecular pump 100, the deposited substance narrows the flow passage of the pump, which causes deterioration in the performance of the turbo-molecular pump 100.

The above-mentioned product is likely to solidify and adhere in low-temperature portions around the exhaust port, and particularly around the rotary blade 102*d* and the threaded spacer 131. Conventionally, to solve this problem, a heater 147 and an annular water cooling tube 149 are wound around the outer periphery of the base portion 129 etc. and a temperature sensor 151 (e.g., a thermistor) is embedded in, e.g., the base portion 129 to keep the base portion 129 at a fixed high temperature (set temperature) by performing heating operation by the heater 147 and cooling operation by the water cooling tube 149 (hereinafter referred to as TMS (temperature management system.)

It is desirable that the set temperature of TMS is as high as possible since the product is hardly deposited at a higher temperature.

On the other hand, when the base portion 129 is set to a high temperature as stated above, the temperature of the electronic circuit portion 141 exceeds a limit if ambient temperature changes to a high temperature due to the variation in an exhaust load etc., which may destroy a storage formed of a semiconductor memory. In such a case, the semiconductor memory is broken, and control parameters and maintenance information data concerning pump start time, error history, etc. stored in the memory are cleared.

When the maintenance information data is cleared, it is impossible to judge when the maintenance check and exchange of the turbo-molecular pump 100 should be carried out. Therefore, serious problems are caused in the operation of the turbo-molecular pump 100.

Further, a pump ID (identification information) is written in the semiconductor memory. When the power source is turned on, matching between the pump ID and the control device is performed and the pump is operated based on the result. Accordingly, when the data of the pump ID etc. is cleared, the turbo-molecular pump 100 cannot be restarted.

Similarly, when the temperature of the base portion 129 becomes high, current flowing through electromagnetic windings constituting the magnetic poles increases due to the variation in an exhaust load etc., which may cause the temperature of the motor 121 to exceed an allowable temperature. In this case, the electromagnetic windings are broken and the motor stops.

Further, the mold material of the electromagnetic windings melts, and the retention force of the mold material decreases. As a result, the arrangement positions of the electromagnets are shifted, which reduces the rotational driving force of the motor or stops the rotation of the motor.

Prior patent document 1 (Japanese Patent Laid-Open Pub. No. 2002-257079) discloses a control method as a TMS control method. Specifically, in a controller of this patent document 1, a minimum set temperature and a maximum set temperature are previously set as temperature threshold values so that a heater operates only when the temperature inside the pump body is lower than the minimum set temperature and that a cooling unit operates only when the temperature inside the pump body is higher than the maximum set temperature. When the temperature inside the pump body is between the minimum set temperature and the maximum set temperature, both of the heater and the control valve are turned off. In this way, energy loss due to temperature control can be reduced.

Further, a minimum operation time is set for each of the heater and the valve so that each of the period since the heater is turned on until the heater is turned off again by the controller and the period since the control valve is opened until the control valve is closed again by the controller becomes longer than the set minimum operation time. In this way, the chattering of the heater and the control valve can be prevented.

SUMMARY

However, in patent document 1, one target whose temperature must be controlled requires one set consisting of a heater, a water-cooling pipe, and a control device for controlling the heater and the water-cooling pipe. That is, this system requires a set consisting of a heating unit, a cooling unit, and a control device for each target, corresponding to the number of targets. Accordingly, when a plurality of targets are set in the pump and temperature sensors are arranged for the respective targets, sets each consisting of a heating unit, a cooling unit, and a control device are required corresponding to the number of targets. This leads to a problem that the system is increased in size and more complicated, which increases facility investment.

Further, when a plurality of targets having temperatures to be controlled are provided with heating units and cooling units corresponding to the number of targets, there is a fear that an energy loss is caused when heating operation and cooling operation are performed at the same time, which is because heating energy and cooling energy counteract each other.

The present invention has been made in view of these conventional problems, and an object of the present invention is to provide a vacuum pump capable of performing temperature control using one or more heating devices or cooling devices fewer than the number of temperature sensors arranged in the pump.

Accordingly, the present invention has been made to provide a vacuum pump for exhausting gas from a target device, including: a plurality of temperature sensors arranged in different: places in the vacuum pump; one or more cooling units and/or heating units fewer than the number of temperature sensors; and a temperature controller for controlling the cooling unit and/or the heating unit based on a plurality of temperature signals outputted from the temperature sensors.

The number of cooling units or heating units is smaller than the number of temperature sensors. In a conventional technique for controlling a vacuum pump, the number of control targets and the number of cooling units or heating units must be constantly the same. In the present invention, difference in the number is covered by generating a control signal based on predetermined rules.

As stated above, the number of heating units or cooling units to be provided for a plurality of targets can be reduced, which realizes reduction in size and cost of the temperature control system. Further, even when control commands contradicting each other are simultaneously derived for the heating unit or cooling unit based on the temperature information detected by a plurality of temperature sensors, heating energy or cooling energy is not wastefully used.

Further, in the present invention, the temperature controller selects, from the temperature signals, a to-be-controlled temperature signal, which is a temperature signal having a temperature signal value out of a predetermined acceptable range, and the temperature controller controls the cooling unit and/or the heating unit based on the to-be-controlled temperature signal.

As stated above, temperatures of a plurality of places provided with temperature sensors in the vacuum pump can be controlled by one or more cooling units or heating units fewer than the number of temperature sensors, by previously setting an acceptable range of the temperature signal value outputted from each temperature sensor so that the cooling unit or the heating unit is controlled based on the temperature to be controlled, which is a temperature signal having a temperature signal value out of the acceptable range as a result of increase or decrease.

Further, in the present invention, the temperature controller selects the to-be-controlled temperature signal from a plurality of temperature signals included in the temperature signals and having temperature signal values out of the predetermined acceptable range so that the selection is made in accordance with predetermined priorities of the temperature signals, and the temperature controller controls the cooling unit and/or the heating unit based on the to-be-controlled temperature signal.

As stated above, by setting priorities for the temperature sensors, it is made possible that the temperature of a target provided with a temperature sensor given a higher priority is settled within the acceptable range by performing quick control and then the temperature of a target provided with a temperature sensor given a next higher priority is settled within the acceptable range.

As stated above, the number of heating units or cooling units to be provided for a plurality of targets can be reduced, which produces effect of reduction in size and cost of the temperature control system.

Further, in the present invention, the temperature controller derives a plurality of control commands based on a plurality of temperature signals included in the temperature signals and having temperature signal values out of the predetermined acceptable range, and the temperature controller controls the cooling unit and/or the heating unit based on a synthesized result of the control commands.

As a synthesized result of the control commands, the following can be used: the sum total value, multiplication value, and average value of the control command values; and the sum total value, multiplication value, and average value of weighted values of the control command values. When performing ON/OFF control on the cooling unit and/or the heating unit, the logical sum, logical product, etc. of ON commands or OFF commands can be used.

As stated above, by controlling the cooling unit and/or the heating unit based on a synthesized result of a plurality of control commands, the number of heating units or cooling units provided for a plurality of targets can be reduced while equally treating the temperature sensors without making any difference therebetween. Accordingly, effect of reduction in size and cost of the temperature control system can be achieved.

As explained above, according to the present invention, the number of cooling units or heating units is smaller than the number of temperature sensors, which leads to reduction in size and cost of the temperature control system. Further, even when control commands contradicting each other are simultaneously derived for the heating unit or cooling unit based on the temperature information detected by a plurality of temperature sensors, heating energy or cooling energy is not wastefully used.

DETAILED DESCRIPTION

Figure 1:
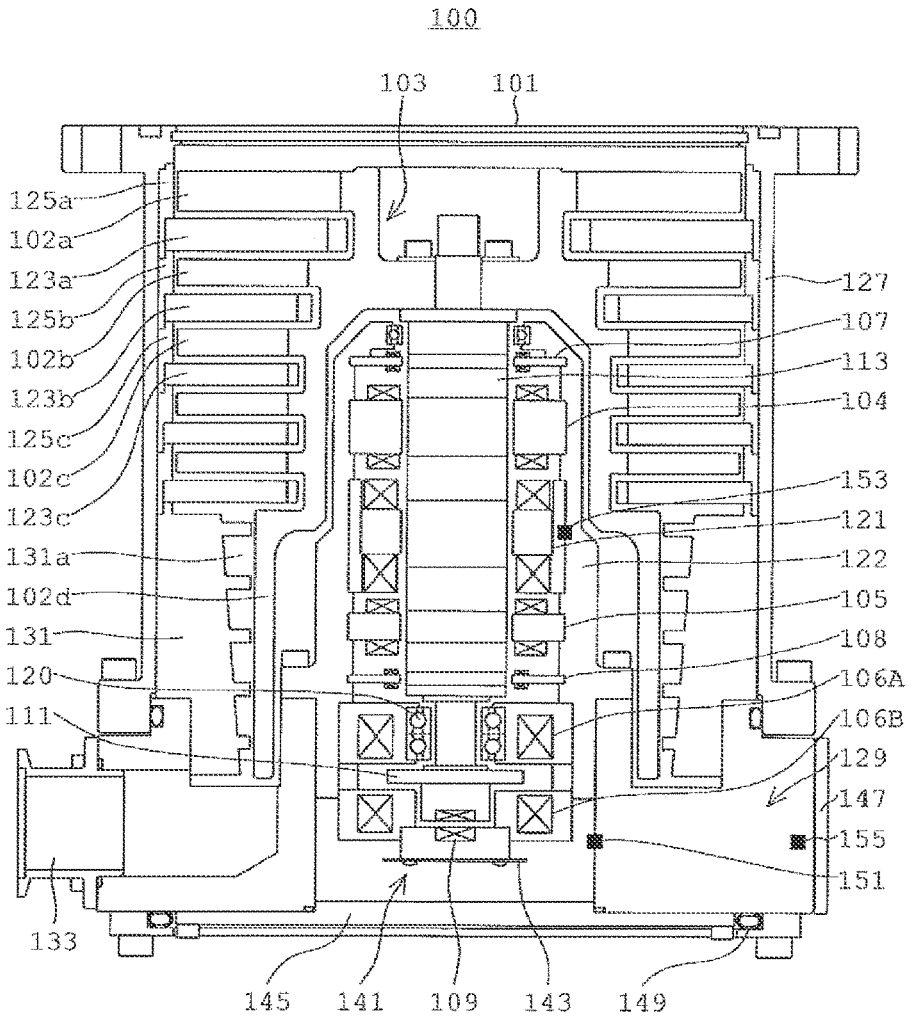
FIG. 1 A block diagram (showing the arrangement of temperature sensors) of a turbo-molecular pump according to a first embodiment of the present invention FIG. 2 A block diagram schematically showing the whole system FIG. 3 An example of a temperature control timing chart when priorities are set for the temperature sensors.

Hereinafter, a first embodiment of the present invention will be explained. FIG. 1 is a block diagram of a turbo-molecular pump according to the first embodiment of the present invention, and FIG. 2 is a block diagram schematically showing the whole system, Note that FIG. 1 and FIG. 2 will be similarly applied to each of the other embodiments to be explained later.

Figure 2:
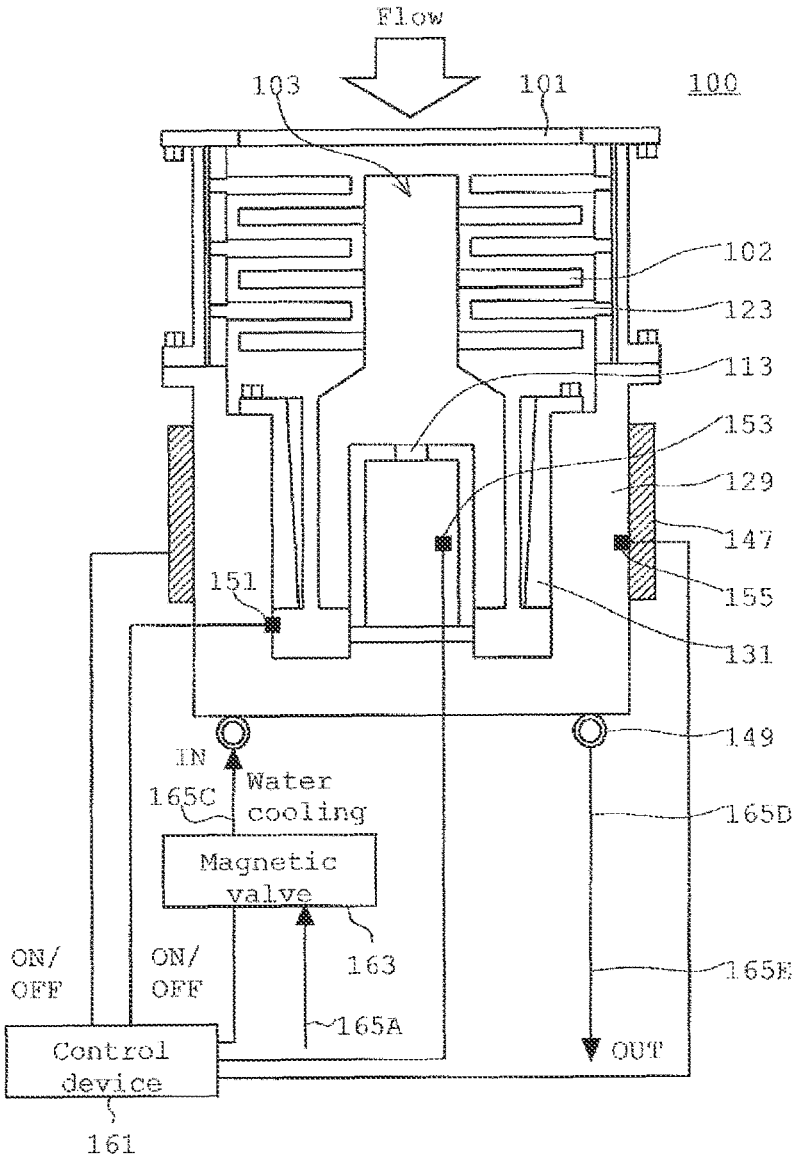

In FIG. 1 and FIG. 2, the motor 121 has a motor temperature sensor 153 (e.g., thermistor) for measuring the temperature thereof. Further, the inner side temperature of the base portion 129 is measured by a TMS temperature sensor 151, and monitored so as not to let the temperature of the gas flow channel become a set temperature or smaller, while the outer side temperature of the base portion 129 is measured and monitored by an OP sensor 155. Detection signals of the motor temperature sensor 153, the TMS temperature sensor 151, and the OP sensor 155 are transmitted to a control device 161.

The control device 161 transmits an ON/OFF control command signal to the heater 147, and transmits an ON/OFF control command signal to a magnetic valve 163 for controlling the cooling water flowing through the water-cooling pipe 149. When the ON command signal is transmitted to the magnetic valve 163, the valve is opened to pass cooling water through the water-cooling pipe 149, and when the OFF command signal is transmitted, the valve is closed not to pass cooling water through the water-cooling pipe 149.

Next, explanation will be made on a timing chart of temperature control. One temperature sensor is arranged for each target in the pump, while only one set consisting of the heater 147 and the magnetic valve 163 is arranged. In the present first embodiment, one set consisting of a heater and a magnetic valve is controlled based on output signals from a plurality of temperature sensors, based on the priorities set for the temperature sensors.

Figure 3:
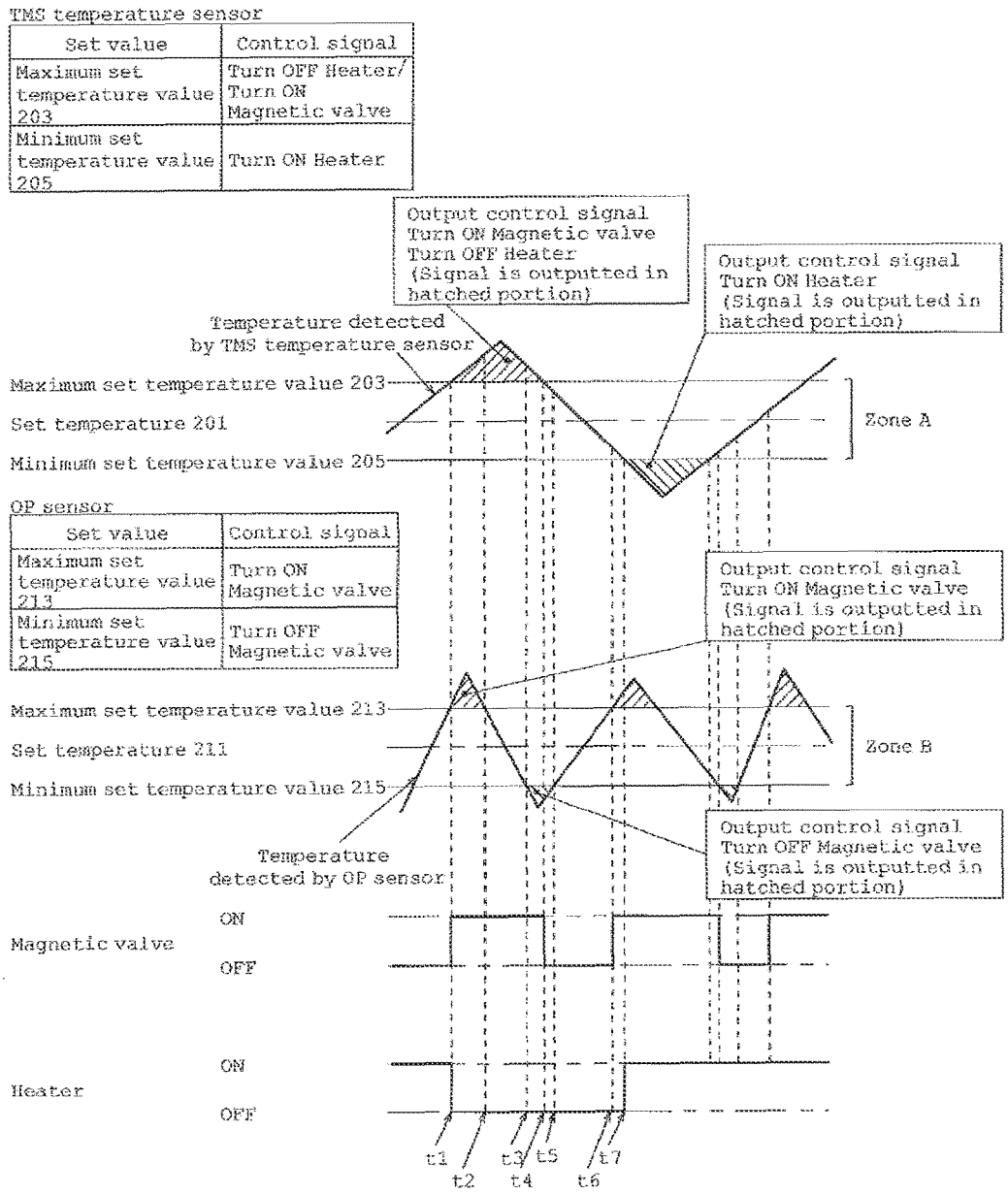

FIG. 3 shows an example of a temperature control timing chart when priorities are set for the temperature sensors. In FIG. 3, detection signals of the TMS temperature sensor 151 and the OP sensor 155 are shown on the upper side, and a magnetic valve control command signal and a heater control command signal generated based on these detection signals are shown on the lower side. Set temperatures 201 and 211 are provided for the detection signal of the TMS temperature sensor 151 and the detection signal of the OP sensor 155, respectively.

A maximum set temperature value 203 is provided to turn off the heater 147 and turn on the magnetic valve 163 when the inner side temperature detected by the TMS temperature sensor 151 increases, in order that the inner side temperature of the base portion 129 is settled at the set temperature 201. To the contrary, a minimum set temperature value 205 is provided to turn on the heater 147 when the inner side temperature decreases.

Similarly, a maximum set temperature value 213 is provided to turn on the magnetic valve 163 when the outer side temperature detected by the OP sensor 155 increases, in order that the outer side temperature of the base portion 129 is settled at the set temperature 211. To the contrary, a minimum set temperature value 215 is provided to turn off the magnetic valve 163 when the outer side temperature decreases.

Here, when controlling the heater 147 and the magnetic valve 163, a higher priority is given to the control command derived from the detection signal of the TMS temperature sensor 151 than to the control command derived from the detection signal of the OP sensor 155.

Note that control for turning off the magnetic valve 163 is performed based only on the OP sensor 155. Further, each of a zone A between the maximum set temperature value 203 and the minimum set temperature value 205 and a zone B between the maximum set temperature value 213 and the minimum set temperature value 215 is defined as an acceptable range of the detection signal of the temperature sensor. When the detection signal of the temperature sensor is within this zone, no control command is derived for the heater 147 and the magnetic valve 163, and the previous instruction is continuously applied.

Hereinafter, explanation will be made in chronological order. First, at time t1, the detection signal of the TMS temperature sensor 151 (the inner side temperature of the base portion 129) exceeds the maximum set temperature value 203, from which an ON command for the magnetic valve 163 and an OFF command for the heater 147 are derived. Further, at t1, the detection signal of the OP sensor 155 (the outer side temperature of the base portion 129) exceeds the maximum set temperature value 213, from which an ON command for the magnetic valve 163 is derived. Since the detection signal of the OP sensor 155 is similar to the detection signal of the TMS temperature sensor 151 (an ON command for the magnetic valve 163), an ON command signal is generated as a control signal of the magnetic Valve 163 and an OFF command signal is generated as a control signal of the heater 147.

This state is kept until t2, at which the detection signal of the OP sensor 155 enters the zone B below the maximum set temperature value 213. Since the previous instruction is continuously applied in the zone B, the ON signal for the magnetic valve 163 and the OFF signal for the heater 147 are continuously applied until t3.

At t3, the detection signal of the OP sensor 155 becomes less than the minimum set temperature value 215, from which an OFF command for the magnetic valve 163 is derived. However, since a higher priority is given to the detection signal of the TMS temperature sensor 151 than to the detection signal of the OP sensor 155 in accordance with the priorities of the temperature signals, the ON signal for the magnetic valve 163 and the OFF signal for the heater 147 are continuously applied until t4, at which the detection signal of the TMS temperature sensor 151 becomes less than the maximum set temperature value 203.

When the detection signal of the TMS temperature sensor 151 is within the zone A, an OFF command for the magnetic valve 163 is derived from the detection signal of the OP sensor 155, and thus an OFF command signal is generated as a control command signal for the magnetic valve 163 until t5. In the period from t5 to t6, the detection signals are within the zone A and the zone B, in which the previous instruction is continuously applied, and thus the OFF command signal is continuously applied as a control command signal for the magnetic valve 163.

In the period from t3 to t5, the detection signal of the OP sensor 155 shifts from decrease to increase although the heater 147 is turned off, This is because the pump is heated to some extent due to the current flowing through the motor and the magnetic bearing, friction between the rotor and gas, etc. even when the heater 147 is turned off, and further because cooling water does not flow through the pump since the magnetic valve 163 is turned off at t3.

At t6, the detection signal of the OP sensor 155 exceeds the maximum set temperature value 213 again, from which an ON command for the magnetic valve 163 is derived. Since the detection signal of the TMS temperature sensor 151 is within the zone A at this time, an ON signal is generated as a control command signal for the magnetic valve 163. At t7, the detection signal of the TMS temperature sensor 151 becomes less than the minimum set temperature value 205, by which an ON signal for the heater 147 is generated, Hereinafter, similar processes are repeated.

As stated above, by setting priorities for the temperature sensors, the temperature of a target provided with a temperature sensor given a higher priority is settled within the acceptable range by performing quick ON/OF control, and then the temperature of a target provided with a temperature sensor given a lower priority is settled within the acceptable range.

As stated above, the number of heaters and magnetic valves to be provided for a plurality of targets can be reduced, which realizes reduction in size and cost of the temperature control system. Further, even when control commands contradicting each other are simultaneously derived for the heating unit or cooling unit based on the temperature information detected by a plurality of temperature sensors, heating energy or cooling energy is not wastefully used.

In the above explanation, two temperature sensors are controlled by one set consisting of a heater and a magnetic valve based on the priorities given thereto, but a similar control can be realized when three or more temperature sensors are arranged.

Figure 4:
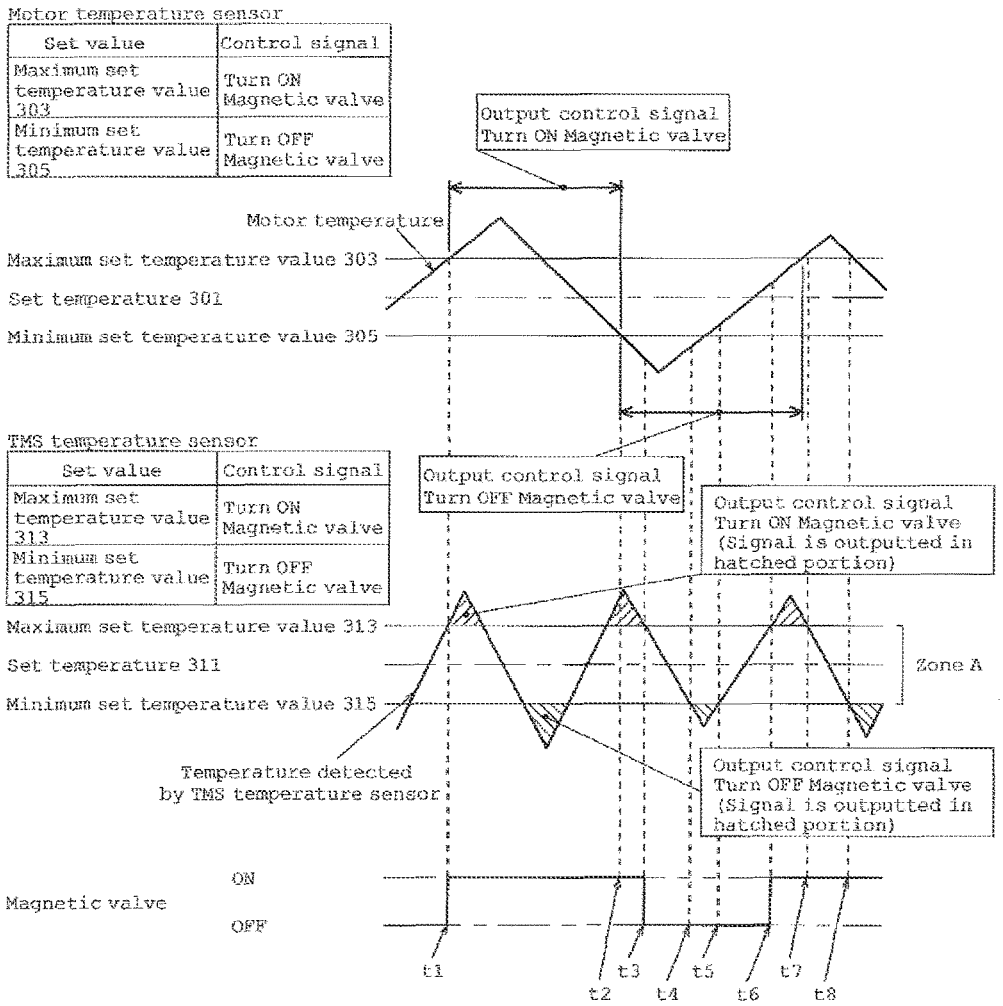
FIG. 4 A timing chart of a turbo-molecular pump according to a second embodiment of the present invention.

Next, a second embodiment of the present invention will be explained. FIG. 4 is a timing chart of a turbo-molecular pump according to the second embodiment of the present invention. Note that block diagrams will be omitted in the present embodiment since FIG. 1 and FIG. 2 can be similarly applied, In FIG. 4, detection signals of the motor temperature sensor 153 and the TMS temperature sensor 151 are shown on the upper side, and a magnetic valve control command signal and a heater control command signal generated based on these detection signals are shown on the lower side. Note that a heater control command signal is omitted since it is similar to the first embodiment.

Set temperatures 301 and 311 are provided for the detection signal of the motor temperature sensor 153 and the detection signal of the TMS temperature sensor 151, respectively. A maximum set temperature value 303 is provided to turn on the magnetic valve 163 when the temperature detected by the motor temperature sensor 153 increases, in order that the temperature of the motor 121 is settled at the set temperature 301. To the contrary, a minimum set temperature value 305 is provided to turn off the magnetic valve 163 when the temperature decreases.

Similarly, a maximum set temperature value 313 is provided to turn on the magnetic valve 163 when the temperature detected by the TMS temperature sensor 151 increases, in order that the inner side temperature of the base portion 129 is settled at the set temperature 311. To the contrary, a minimum set temperature value 315 is provided to turn off the magnetic valve 163 when the temperature decreases.

In the present embodiment, a higher priority is given to the ON command when controlling the heater 147 and the magnetic valve 163. Specifically, a control signal serving as an ON command is generated based on a logical sum.

Further, the control command for the magnetic valve 163 based on the motor temperature sensor 153 is not changed until the temperature falls below the minimum set temperature value 305 when the temperature exceeds the maximum set temperature value 303, and is not changed until the temperature exceeds the maximum set temperature value 303 when the temperature becomes the minimum set temperature value 305 or less. This rule is not applied to the control command for the magnetic valve 163 based on the TMS temperature sensor 151.

Similarly to the first embodiment, when the detection signal of the TMS temperature sensor 151 is within the zone A between the maximum set temperature value 313 and the minimum set temperature value 315, the previous command is continuously applied as a control command for the magnetic valve 163 based on the TMS temperature sensor 151.

Hereinafter, explanation will be made in chronological order. First, at time t1, the detection signal of the motor temperature sensor 153 exceeds the maximum set temperature value 303, from which an ON command for the magnetic valve 163 is derived. Then, this ON command is continuously applied until the detection signal falls below the minimum set temperature value 305.

Further, at t1, the detection signal of the TMS temperature sensor 151 exceeds the maximum set temperature value 313, from which an ON command for the magnetic valve 163 is derived. Since the detection signal of the TMS temperature sensor 151 is similar to the detection signal of the motor temperature sensor 153, an ON command signal is generated as a control signal of the magnetic valve 163. Since a higher priority is given to the ON command when controlling the magnetic valve 163, the ON command signal for the magnetic valve 163 is continuously applied until t2, at which the detection signal of the motor temperature sensor 153 falls below the minimum set temperature value 305.

After that, until t3, an OFF command for the magnetic valve 163 is derived from the detection signal of the motor temperature sensor 153, but an ON command for the magnetic valve 163 is derived since the detection signal of the TMS temperature sensor 151 still exceeds the maximum set temperature value 313. In this case, based on the logical sum of the two commands, an ON command signal is generated as a control command signal for the magnetic valve 163. In the period from t3 to t4, an OFF command for the magnetic valve 163 is derived from the detection signal of the motor temperature sensor 153. On the other hand, the detection signal of the TMS temperature sensor 151 is within the zone A, and thus an OFF command signal for the magnetic valve 163 is generated.

In the period from t4 to t5, an OFF command for the magnetic valve 163 is derived from the detection signal of the TMS temperature sensor 151, while an OFF command for the magnetic valve 163 is derived from the motor temperature sensor 153. As a result, the OFF command signal for the magnetic valve 163 is continuously applied.

In the period from t5 to t6, the detection signal of the TMS temperature sensor 151 is within the zone A, while an OFF command for the magnetic valve 163 is derived from the motor temperature sensor 153. Thus, the OFF command signal is continuously applied as a control command signal for the magnetic valve 163. Then, at t6, the detection signal of the TMS temperature sensor 151 exceeds the maximum set temperature value 313 and an ON command for the magnetic valve 163 is derived, while an OFF command for the magnetic valve 163 is derived from the motor temperature sensor 153. Accordingly, based on the logical sum of the two commands, an ON command signal for the magnetic valve 163 is generated.

In the period from t7 to t8, an ON command for the magnetic valve 163 is derived from the motor temperature sensor 153, while the detection signal of the TMS temperature sensor 151 is within the zone A. Accordingly, the ON command signal for the magnetic valve 163 is continuously applied.

At t8 or thereafter, the detection signal of the TMS temperature sensor 151 falls below the minimum set temperature value 315, but the ON command signal for the magnetic valve 163 is continuously applied since the ON command for the magnetic valve 163 is still derived from the motor temperature sensor 153. As stated above, even when control is performed giving a higher priority to the ON command, an effect similar to the first embodiment can be obtained. That is, the effect is that the magnetic valve 163 and the heater 147 can be controlled based on a plurality of temperature sensors.

In the example explained in the present embodiment, an ON command signal for the magnetic valve 163 is generated using the logical sum of an ON command based on the detection signal of the motor temperature sensor 153 and an ON command based on the detection signal of the TMS temperature sensor 151. It is also possible to generate an OFF command signal for the heater 147 using the logical sum of an OFF command based on the detection signal of the motor temperature sensor 153 and an OFF command based on the detection signal of the TMS temperature sensor 151.

Figure 5:
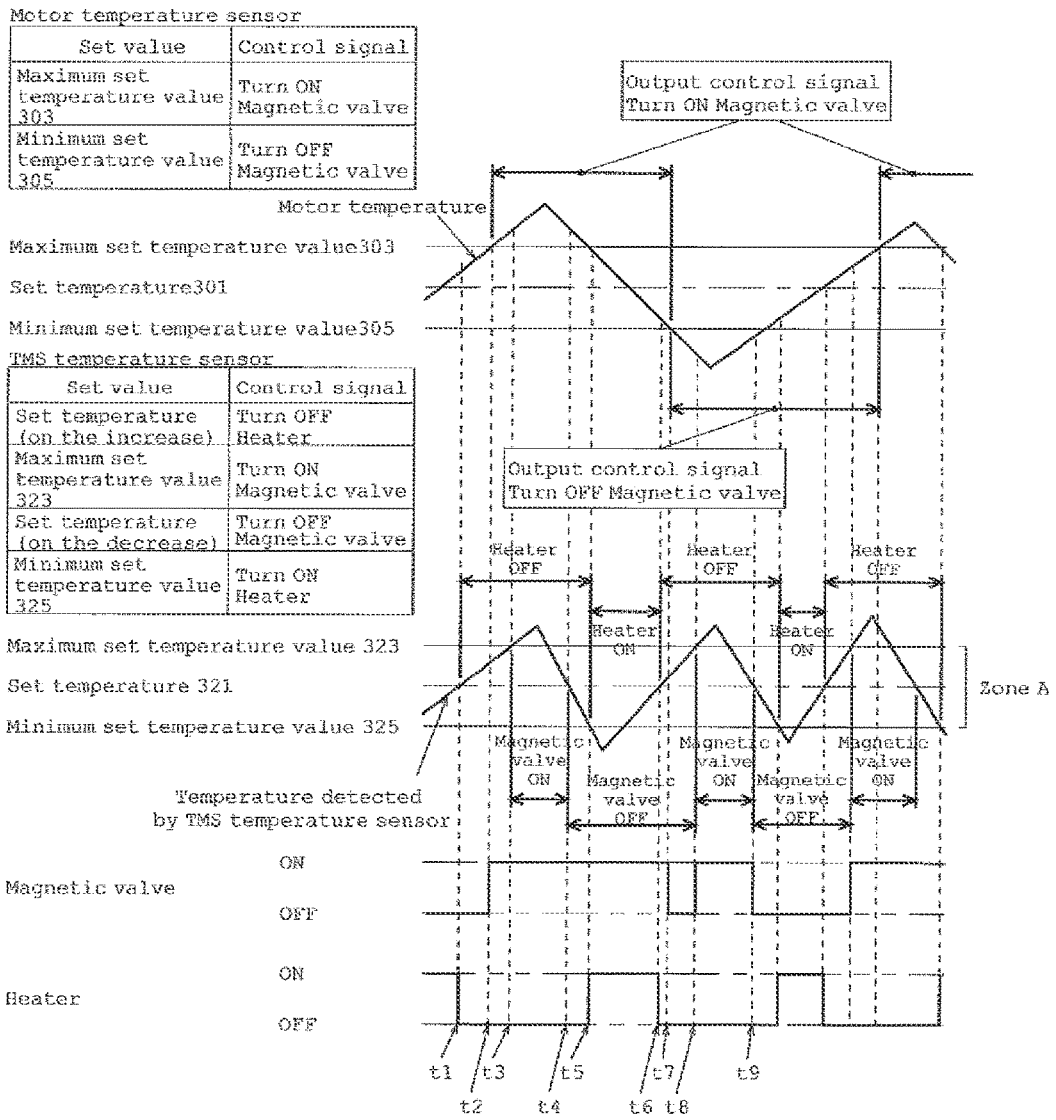
FIG. 5 A timing chart of a turbo-molecular pump according to a third embodiment of the present invention.
Figure 6:
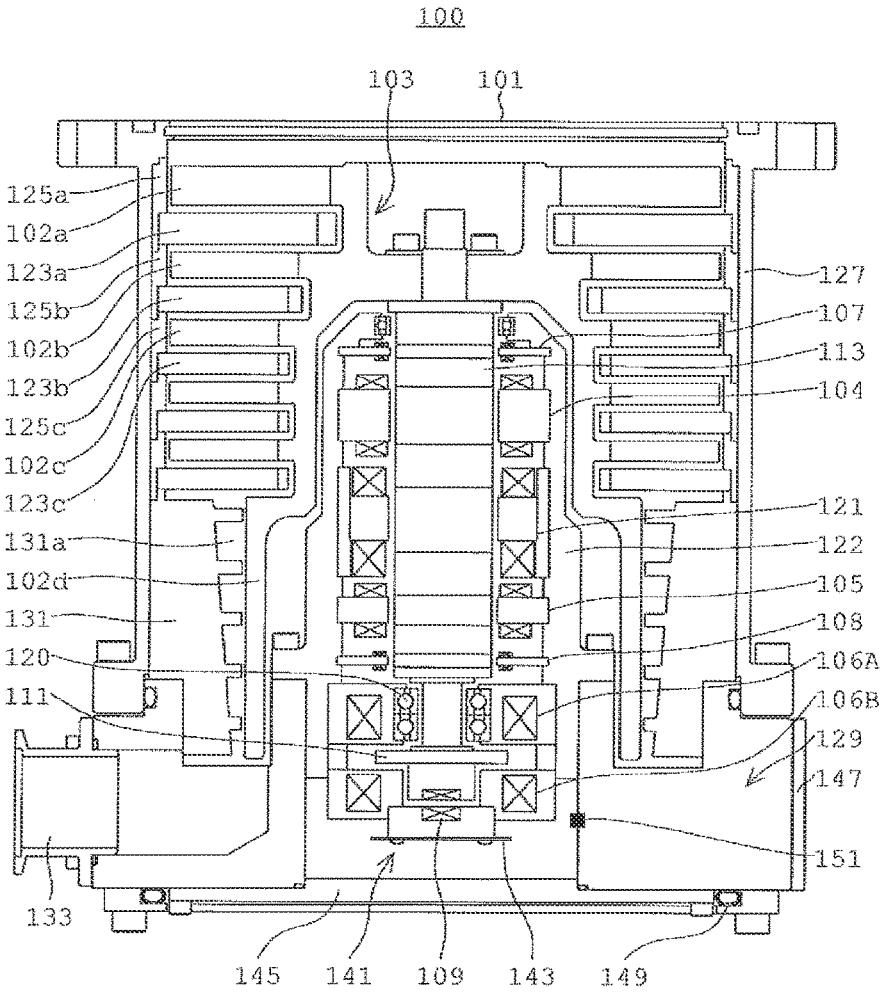
FIG. 6 A longitudinal sectional view of a turbo-molecular pump.

Next, a third embodiment of the present invention will be explained. FIG. 5 shows a timing chart of a turbo-molecular pump according to the third embodiment of the present invention. Note that block diagrams will be omitted in the present embodiment since FIG. 1 and FIG. 2 can be similarly applied. In FIG. 5, detection signals of the motor temperature sensor 153 and the TMS temperature sensor 151 are shown on the upper side, and a magnetic valve control command signal and a heater control command signal generated based on these detection signals are shown on the lower side.

Set temperatures 301 and 321 are provided for the detection signal of the motor temperature sensor 153 and the detection signal of the TMS temperature sensor 151, respectively. A maximum set temperature value 303 is provided to turn on the magnetic valve 163 when the temperature detected by the motor temperature sensor 153 increases, in order that the temperature of the motor 121 is settled at the set temperature 301. To the contrary, a minimum set temperature value 305 is provided to turn off the magnetic valve 163 when the temperature decreases.

Similarly, the heater 147 is turned off when the detection signal of the TMS temperature sensor 151 exceeds the set temperature 321, in order that the inner side temperature of the base portion 129 is settled at the set temperature 321. Once the heater 147 is turned off, this OFF command is continuously applied until the detection signal falls below a minimum set temperature value 325. After that, when the detection signal falls below the minimum set temperature value 325, the heater 147 is turned on. Further, control is performed so that the magnetic valve 163 is turned on when the temperature exceeds a maximum set temperature value 323, and that the magnetic valve 163 is turned off when the temperature falls below the set temperature 321. After that, the magnetic valve 163 is turned on when the temperature exceeds the maximum set temperature value 323.

In the present embodiment, similarly to the second embodiment, a higher priority is given to the ON command when controlling the heater 147 and the magnetic valve 163. Specifically, a control command signal serving as an ON command signal is generated based on a logical sum.

As long as no abnormality is caused in heating, an ON command signal for the heater 147 may be generated similarly to the magnetic valve 163, by using the logical sum of ON commands derived from the detection signals of a plurality of temperature sensors.

Further, when the temperature exceeds the maximum set temperature value 303, the control command for the magnetic valve 163 based on the motor temperature sensor 153 is continuously applied until the temperature falls below the minimum set temperature value 305. Further, when the temperature becomes the minimum set temperature value 305 or less, the control command for the magnetic valve 163 based on the motor temperature sensor 153 is continuously applied until the temperature exceeds the maximum set temperature value 303. This rule is not applied to the control command for the magnetic valve 163 based on the TMS temperature sensor 151.

Hereinafter, explanation will be made in chronological order. First, at time t1, the detection signal of the TMS temperature sensor 151 exceeds the set temperature 321, and thus the heater 147 is turned off. Further, the magnetic valve 163 is turned off. At t2, the detection signal of the motor temperature sensor 153 exceeds the maximum set temperature value 303, from which an ON command for the magnetic valve 163 is derived. This ON command based on the motor temperature sensor 153 is continuously applied until the detection signal falls below the minimum set temperature value 305. On the other hand, at time t2, an OFF command for the magnetic valve 163 is derived from the TMS temperature sensor 151. As a result, an ON signal for the magnetic valve 163 is generated based on the logical sum of the two commands.

At t3, the detection signal of the TMS temperature sensor 151 exceeds the maximum set temperature value 323 and thus an ON command for the magnetic valve 163 is derived, while an ON command for the magnetic valve 163 is also derived from the motor temperature sensor 153. Based on the logical sum of the two ON commands, an ON signal for the magnetic valve 163 is generated.

At t4, the detection signal of the TMS temperature sensor 151 falls below the set temperature 321 and thus an OFF command for the magnetic valve 163 is derived, while an ON command for the magnetic valve 163 is derived from the motor temperature sensor 153. Based on the logical sum of the two commands, an ON signal for the magnetic valve 163 is generated since the ON command is given a higher priority.

At t5, the detection signal of the TMS temperature sensor 151 falls below the minimum set temperature value 325, from which an ON command for the heater 147 is derived and an ON signal for the heater 147 is generated. At this time, the ON command for the magnetic valve 163 is continuously applied based on the motor temperature sensor 153, and thus an ON signal for the magnetic valve 163 is continuously generated.

At t6, the detection signal of the TMS temperature sensor 151 exceeds the set temperature 321, from which an OFF command for the heater 147 is derived and the heater 147 is turned off. Since the ON command for the magnetic valve 163 is continuously derived from the detection signal of the motor temperature sensor 153, the ON signal for the magnetic valve 163 is continuously applied.

At t7, an OFF command for the magnetic valve 163 is derived from the TMS temperature sensor 151. At this time, the detection signal of the motor temperature sensor 153 falls below the minimum set temperature value 305, from which an OFF command for the magnetic valve 163 is derived. Based on the logical sum of the two OFF commands, an OFF signal for the magnetic valve 163 is generated as a control command signal.

At t8, the detection signal of the motor temperature sensor 153 falls below the minimum set temperature value 305 and thus it is judged that the OFF command for the magnetic valve 163 should be continuously applied, while an ON command for the magnetic valve 163 is derived from the TMS temperature sensor 151. Based on the logical sum of the two commands, an ON signal for the magnetic valve 163 is generated.

At t9, the detection signal of the TMS temperature sensor 151 falls below the set temperature 321, from which an OFF command for the magnetic valve 163 is derived. On the other hand, an OFF command for the magnetic valve 163 is derived from the motor temperature sensor 153. Since both of them are OFF commands, the magnetic valve 163 is turned off, Hereinafter, similar processes are repeated. As stated above, an effect similar to the second embodiment can be obtained also in the third embodiment.

EXPLANATION OF REFERENCE NUMERALS

100: Turbo-molecular pump; 121: Motor; 129: Base portion; 147: Heater; 149: Water-cooling pipe; 151: TMS temperature sensor; 153: Motor temperature sensor; 155: OP sensor; 161: Control device; 163: Magnetic valve; 201, 211, 301, 311, and 321: Set temperature; 203, 213, 303, 313 and 323: Maximum set temperature value; 205, 215, 305, 315, and 325: Minimum set temperature value

The invention claimed is:

1. A vacuum pump for exhausting gas from a target device, comprising:

a plurality of temperature sensors arranged in different places in the vacuum pump;

one or more cooling units and one or more heating units, wherein the number of cooling units is less than the number of temperature sensors, and wherein the number of heating units is less than the number of temperature sensors; and a temperature controller for controlling the one or more cooling units and the one or more heating units based on a plurality of temperature signals outputted from the temperature sensors to first settle a first temperature signal of the plurality of the temperature signals outputted from the plurality of temperature sensors within a first predetermined acceptable range by ON/OFF control of the cooling units or the heating units, then, after the first temperature signal is settled, to settle a second temperature signal of the plurality of the temperature signals outputted from the plurality of temperature sensors within a second predetermined acceptable range by ON/OFF control of the cooling units or the heating units, wherein the temperature controller causes the first temperature signal to be settled with a higher priority than the second temperature signal, wherein the temperature controller causes a first place of the different places in which a first temperature sensor outputs the first temperature signal and a second place of the different places in which a second temperature sensor outputs the second temperature signal to be cooled or heated such that the temperature controller causes the first place and the second place to be cooled at the same time, or the first place and the second place to be heated at the same time.

2. The vacuum pump of claim 1, wherein the temperature controller selects, from the temperature signals, a to-be-controlled temperature signal, which is a temperature signal having a temperature signal value out of at least one of the first predetermined acceptable range or the second predetermined acceptable range, and the temperature controller controls the one or more cooling units and the one or more heating units based on the to-be-controlled temperature signal.

3. The vacuum pump of claim 2, wherein the temperature controller selects the to-be-controlled temperature signal from a plurality of temperature signals included in the temperature signals and having temperature signal values out of the at least one of the first predetermined acceptable range or the second predetermined acceptable range, and the temperature controller controls the one or more cooling units and the one or more heating units based on the to-be-controlled temperature signal.

4. The vacuum pump of any one of claims 1 to 3, wherein the temperature controller derives a plurality of control commands based on a plurality of temperature signals included in the temperature signals and having temperature signal values out of the at least one of the first predetermined acceptable range or the second predetermined acceptable range, and the temperature controller controls the one or more cooling units and the one or more heating units based on a synthesized result of the control commands.

5. A method comprising:

receiving, by a temperature controller, a plurality of temperature signals outputted by a plurality of temperature sensors arranged in different places in a vacuum pump;

controlling, by the temperature controller, one or more cooling units and one or more heating units in the vacuum pump based on the plurality of temperature signals, wherein the number of cooling units is less than the number of temperature sensors, and wherein the number of heating units is less than the number of temperature sensors, wherein the controlling comprises:

first settling a first temperature signal of the plurality of the temperature signals outputted from the plurality of temperature sensors within a first predetermined acceptable range by ON/OFF control of the cooling units or the heating units, and then, after the first temperature signal is settled, settling a second temperature signal of the plurality of the temperature signals outputted from the plurality of temperature sensors within a second predetermined acceptable range by ON/OFF control of the cooling units or the heating units, wherein the temperature controller causes the first temperature signal to be settled with a higher priority than the second temperature signal; and causing, by the temperature controller, a first place of the different places in which a first temperature sensor outputs the first temperature signal and a second place of the different places in which a second temperature sensor outputs the second temperature signal to be cooled or heated such that the temperature controller causes the first place and the second place to be cooled at the same time, or the first place and the second place to be heated at the same time.

* * * * *